US008072409B2

(12) United States Patent
Fanchiang et al.

(10) Patent No.: US 8,072,409 B2
(45) Date of Patent: Dec. 6, 2011

(54) LCD WITH COMMON VOLTAGE DRIVING CIRCUITS

(75) Inventors: Kuohao Fanchiang, Hsinchu (TW); Kung-Yi Chan, Hsinchu (TW); Huan-Hsin Li, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 526 days.

(21) Appl. No.: 12/392,796

(22) Filed: Feb. 25, 2009

(65) Prior Publication Data

US 2010/0214204 A1 Aug. 26, 2010

(51) Int. Cl.
*G09G 3/36* (2006.01)

(52) U.S. Cl. ..... 345/98; 345/100

(58) Field of Classification Search ..... 345/98, 345/100, 205, 209
See application file for complete search history.

(56) References Cited

U.S. PATENT DOCUMENTS

| | | | | |
|---|---|---|---|---|
| 7,187,421 | B2 | 3/2007 | Tsunashima et al. | |
| 2005/0088395 | A1 | 4/2005 | Chung | |
| 2006/0284811 | A1 | 12/2006 | Huang | |
| 2008/0036751 | A1 * | 2/2008 | Yamazaki | 345/205 |
| 2008/0055300 | A1 * | 3/2008 | Yamazaki | 345/212 |
| 2008/0094388 | A1 * | 4/2008 | Yamazaki | 345/212 |
| 2008/0291223 | A1 * | 11/2008 | Yamazaki et al. | 345/690 |
| 2009/0015570 | A1 * | 1/2009 | Yamazaki | 345/204 |

FOREIGN PATENT DOCUMENTS

EP 1973094 A2 9/2008

* cited by examiner

*Primary Examiner* — Kevin M Nguyen
*Assistant Examiner* — Sepideh Ghafari
(74) *Attorney, Agent, or Firm* — Morris Manning & Martin LLP; Tim Tingkang Xia, Esq.

(57) ABSTRACT

An LCD with power consumption reduction and a method of driving the same. In one embodiment, the LCD has a plurality of pixels spatially arranged in the form of a matrix having N pixel rows, each pixel row defined between two neighboring scanning lines $G_n$ and $G_{n+1}$, and having an auxiliary common electrode, and a plurality of common voltage driving circuits, each common voltage driving circuit electrically coupled between the scanning line $G_n$ and the corresponding auxiliary common electrode for providing a two-level lift-up coupling voltage to the auxiliary common electrode.

23 Claims, 5 Drawing Sheets

LCD WITH COMMON VOLTAGE DRIVING CIRCUITS

FIELD OF THE INVENTION

The present invention relates generally to a liquid crystal display (LCD), and more particularly, to an LCD that utilizes a two level lift-up coupling voltage scheme to achieve the row inversion and reduce power consumption and methods of driving same.

BACKGROUND OF THE INVENTION

A liquid crystal display (LCD) device includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (i.e., image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Liquid crystal molecules have a definite orientational alignment as a result of their long, thin shapes. The orientations of liquid crystal molecules in liquid crystal cells of an LCD panel play a crucial role in the transmittance of light therethrough. It is known if a substantially high voltage potential is applied between the liquid crystal layer for a long period of time, the optical transmission characteristics of the liquid crystal molecules may change. This change may be permanent, causing an irreversible degradation in the display quality of the LCD panel. In order to prevent the LC molecules from being deteriorated, an LCD device is usually driven by using techniques that alternate the polarity of the voltages applied across a LC cell. These techniques may include inversion schemes such as frame inversion, row inversion, column inversion, and dot inversion. Typically, notwithstanding the inversion schemes, a higher image quality requires higher power consumption because of frequent polarity conversions. For example, the conventional design with row inversion lost much more power consumption. For the conventional DC Vcom solution, it needs higher data voltage to be column inversion.

Therefore, a heretofore unaddressed need exists in the art to address the aforementioned deficiencies and inadequacies.

SUMMARY OF THE INVENTION

The present invention, in one aspect, relates to an LCD with color washout improvement. In one embodiment, the LCD includes a common electrode, a plurality of scanning lines, $\{G_n\}$, n=1, 2, . . . , N, N being an integer greater than zero, spatially arranged along a row direction, a plurality of data lines, $\{D_m\}$, m=1, 2, . . . , M, M being an integer greater than zero, spatially arranged crossing the plurality of scanning lines $\{G_n\}$ along a column direction perpendicular to the row direction, and a plurality of pixels, $\{P_{n,m}\}$, spatially arranged in the form of a matrix. Each pixel row is defined between two neighboring scanning lines $G_n$ and $G_{n+1}$ and has an auxiliary common electrode ACE. Each pixel $P_{n,m}$ is defined between two neighboring scanning lines $G_n$ and $G_{n+1}$ and two neighboring data lines $D_m$ and $D_{m+1}$ and comprises a pixel electrode, a transistor, T0, having a gate, a source and a drain electrically coupled to the scanning line $G_n$, the data line $D_m$ and the pixel electrode, respectively, a liquid crystal capacitor, Clc, electrically coupled between the pixel electrode and the common electrode, and a charge storage capacitor, Cst, electrically coupled between the pixel electrode and the auxiliary common electrode $ACE_n$.

The LCD also includes a plurality of common voltage driving circuits $\{CT_n\}$ Each common voltage driving circuit $CT_n$ is electrically coupled between the scanning line $G_n$ and the corresponding auxiliary common electrode $ACE_n$ and comprises a first transistor, T1, having a gate electrically coupled to the scanning line $G_n$, a source configured to receive a first voltage, VDC, and a drain electrically coupled to the auxiliary common electrode $ACE_n$, a second transistor, T2, having a gate electrically coupled to the scanning line $G_n$, a source configured to receive a second voltage, $VDC\mathbf{1}_n$, and a drain, a third transistor, T3, having a gate electrically coupled to the scanning line $G_n$, a source configured to receive a third voltage, $VDC\mathbf{2}_n$, and a drain, a fourth transistor, T4, having a gate configured to receive a fourth voltage, $SWC_n$, a source electrically coupled to the drain of the third transistor T3, and a drain electrically coupled to the drain of the second transistor T2, a first capacitor, C1, having a first terminal electrically coupled to the drain of the first transistor T1 and a second terminal electrically coupled to the drain of the second transistor T2, and a second capacitor, C2, having a first terminal electrically coupled to the drain of the third transistor T3 and a second terminal configured to receive a fifth voltage, $VAC_n$.

In one embodiment, each of the first voltage VDC, the second voltage $VDC\mathbf{1}_n$ and the third voltage $VDC\mathbf{2}_n$ is a DC voltage, and wherein each of the fourth voltage $SWC_n$ and the fifth voltage $VAC_n$ is an AC voltage. In one embodiment, $VDC\mathbf{1}_n = VDC\mathbf{2}_{n+1}$, and $VDC\mathbf{2}_n = VDC\mathbf{1}_{n+1}$, and wherein the fourth voltage $SWC_n$ is characterized a waveform that is complimentary to the waveform of a corresponding gate signal $g_n$.

The LCD further comprises a panel having an active area for display and a non-active area adjacent to the active area, wherein the plurality of pixels, $\{P_{n,m}\}$ is formed in the active area of the panel, and wherein the plurality of common voltage driving circuits $\{CT_n\}$ is formed in the non-active area of the panel.

The LCD also comprises a gate driver for generating a plurality of scanning signals respectively applied to the plurality of scanning lines $\{G_n\}$, wherein the plurality of scanning signals is configured to turn on the transistors connected to the plurality of scanning lines $\{G_n\}$ in a predefined sequence, and a data driver for generating a plurality of data signals respectively applied to the plurality of data lines $\{D_m\}$.

In one embodiment, each of the plurality of scanning signals is configured to have a waveform having a first voltage potential, $V_{GH}$, and a second voltage potential, $V_{GL}$, wherein $V_{GH} > V_{GL}$, and wherein the waveform of each of the scanning signals is sequentially shifted from one another.

In another aspect, the present invention relates to an LCD. The LCD has a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, and comprises a common electrode, a plurality of pixels, $\{P_{n,m}\}$, spatially arranged in the form of a matrix having N pixel rows and M pixel columns. Each pixel row is defined between two neighboring scanning lines $G_n$ and $G_{n+1}$ and has an auxiliary common electrode $ACE_n$. Each pixel $P_{n,m}$ is defined between two neighboring scanning lines $G_n$ and $G_{n+1}$ and two neighboring data lines $D_m$ and $D_{m+1}$ and comprises a pixel electrode, a transistor, T0, having a gate, a source and a drain electrically coupled to the scanning line $G_n$, the data line $D_m$ and the pixel electrode, respectively, a liquid crystal capacitor, Clc, electrically coupled between the pixel electrode and the common electrode, and a charge storage capacitor, Cst, electrically coupled between the pixel electrode and the auxiliary common electrode $ACE_n$.

Furthermore, the LCD includes a plurality of common voltage driving circuits $\{CT_n\}$, each common voltage driving circuit $CT_n$, electrically coupled between the scanning line $G_n$ and the corresponding auxiliary common electrode $ACE_n$ for providing a two-level lift-up coupling voltage to the auxiliary common electrode $ACE_n$. In one embodiment, each common voltage driving circuit $CT_n$ comprises a first transistor, T1, having a gate electrically coupled to the scanning line $G_n$, a source configured to receive a first voltage, VDC, and a drain electrically coupled to the auxiliary common electrode $ACE_n$, a second transistor, T2, having a gate electrically coupled to the scanning line $G_n$, a source configured to receive a second voltage, $VDC1_n$, and a drain, a third transistor, T3, having a gate electrically coupled to the scanning line $G_n$, a source configured to receive a third voltage, $VDC2_n$, and a drain, a fourth transistor, T4, having a gate configured to receive a fourth voltage, $SWC_n$, a source electrically coupled to the drain of the third transistor T3, and a drain electrically coupled to the drain of the second transistor T2, a first capacitor, C1, having a first terminal electrically coupled to the drain of the first transistor T1 and a second terminal electrically coupled to the drain of the second transistor T2, and a second capacitor, C2, having a first terminal electrically coupled to the drain of the third transistor T3 and a second terminal configured to receive a fifth voltage, $VAC_n$. Each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

Additionally, the LCD also includes a gate driver for generating a plurality of scanning signals respectively applied to the plurality of scanning lines $\{G_n\}$, wherein the plurality of scanning signals is configured to turn on the transistors connected to the plurality of scanning lines $\{G_n\}$ in a predefined sequence, and a data driver for generating a plurality of data signals respectively applied to the plurality of data lines $\{D_m\}$. In one embodiment, each of the plurality of scanning signals is configured to have a waveform having a first voltage potential, $V_{GH}$, and a second voltage potential, $V_{GL}$, wherein $V_{GH}>V_{GL}$, and wherein the waveform of each of the scanning signals is sequentially shifted from one another.

The LCD further comprises a panel having an active area for display and a non-active area adjacent to the active area, wherein the plurality of pixels, $\{P_{n,m}\}$ is formed in the active area of the panel, and wherein the plurality of common voltage driving circuits $\{CT_n\}$ is formed in the non-active area of the panel.

In yet another aspect, the present invention relates to a method of driving a liquid crystal display (LCD) having a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, and a plurality of pixels, $\{P_{n,m}\}$, spatially arranged in the form of a matrix having N pixel rows and M pixel columns, each pixel row, defined between two neighboring scanning lines $G_n$ and $G_{n+1}$, having an auxiliary common electrode $ACE_n$, each pixel $P_{n,m}$, defined between two neighboring scanning lines $G_n$ and $G_{n+1}$ and two neighboring data lines $D_m$ and $D_{m+1}$, comprising a pixel electrode, a common electrode, a transistor, T0, having a gate, a source and a drain electrically coupled to the scanning line $G_n$, the data line $D_m$ and the pixel electrode, respectively, a liquid crystal capacitor, Clc, electrically coupled between the pixel electrode and the common electrode, and a charge storage capacitor, Cst, electrically coupled between the pixel electrode and the auxiliary common electrode $ACE_n$.

In one embodiment, the method includes the steps of providing a plurality of common voltage driving circuits $\{CT_n\}$, each common voltage driving circuit $CT_n$, electrically coupled between the scanning line $G_n$ and the corresponding auxiliary common electrode $ACE_n$, applying a plurality of scanning signals to the plurality of scanning lines $\{G_n\}$ and a plurality of data signals to the plurality of data lines $\{D_m\}$ respectively, the plurality of scanning signals configured to turn on the switching elements connected to the plurality of scanning lines $\{G_n\}$ in a predefined sequence, and applying a plurality of common voltage driving signals to the plurality of common voltage driving circuits $\{CT_n\}$ so as to responsively generate a plurality of two-level lift-up coupling voltages, each two-level lift-up coupling voltage applied to the auxiliary common electrode $ACE_n$, of a corresponding pixel row. Each common voltage driving signal includes a set of a first voltage VDC, a second voltage $VDC1_n$, a third voltage $VDC2_n$, a fourth voltage $SWC_n$, and a fifth voltage $VAC_n$.

In one embodiment, each common voltage driving circuit comprises a first transistor, T1, having a gate electrically coupled to the scanning line $G_n$, a source configured to receive the first voltage VDC, and a drain electrically coupled to the auxiliary common electrode $ACE_n$, a second transistor, T2, having a gate electrically coupled to the scanning line $G_n$, a source configured to receive the second voltage $VDC1_n$, and a drain, a third transistor, T3, having a gate electrically coupled to the scanning line $G_n$, a source configured to receive the third voltage $VDC2_n$, and a drain, a fourth transistor, T4, having a gate configured to receive the fourth voltage, $SWC_n$, a source electrically coupled to the drain of the third transistor T3, and a drain electrically coupled to the drain of the second transistor T2, a first capacitor, C1, having a first terminal electrically coupled to the drain of the first transistor T1 and a second terminal electrically coupled to the drain of the second transistor T2, and a second capacitor, C2, having a first terminal electrically coupled to the drain of the third transistor T3 and a second terminal configured to receive the fifth voltage, $VAC_n$. Each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage. In operation, the plurality of pixels $\{P_{n,m}\}$ has a pixel polarity that is in the row inversion.

In a further aspect, the present invention relates to a common voltage driving circuit for a liquid crystal display (LCD) having a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, and a plurality of pixels, $\{P_{n,m}\}$, spatially arranged in the form of a matrix having N pixel rows and M pixel columns, each pixel row, defined between two neighboring scanning lines $G_n$ and $G_{n+1}$, having an auxiliary common electrode $ACE_n$.

In one embodiment, the common voltage driving circuit comprises a first transistor, T1, having a gate electrically coupled to the scanning line $G_n$, a source configured to receive the first voltage VDC, and a drain electrically coupled to the auxiliary common electrode $ACE_n$, a second transistor, T2, having a gate electrically coupled to the scanning line $G_n$, a source configured to receive the second voltage $VDC1_n$, and a drain, a third transistor, T3, having a gate electrically coupled to the scanning line $G_n$, a source configured to receive the third voltage $VDC2_n$, and a drain, a fourth transistor, T4, having a gate configured to receive the fourth voltage, $SWC_n$, a source electrically coupled to the drain of the third transistor T3, and a drain electrically coupled to the drain of the second transistor T2, a first capacitor, C1, having a first terminal electrically coupled to the drain of the first transistor T1 and a second terminal electrically coupled to the drain of the second transistor T2, and a second capacitor, C2, having a first terminal electrically coupled to the drain of the third transistor T3 and a second terminal configured to receive the fifth voltage, $VAC_n$. Each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
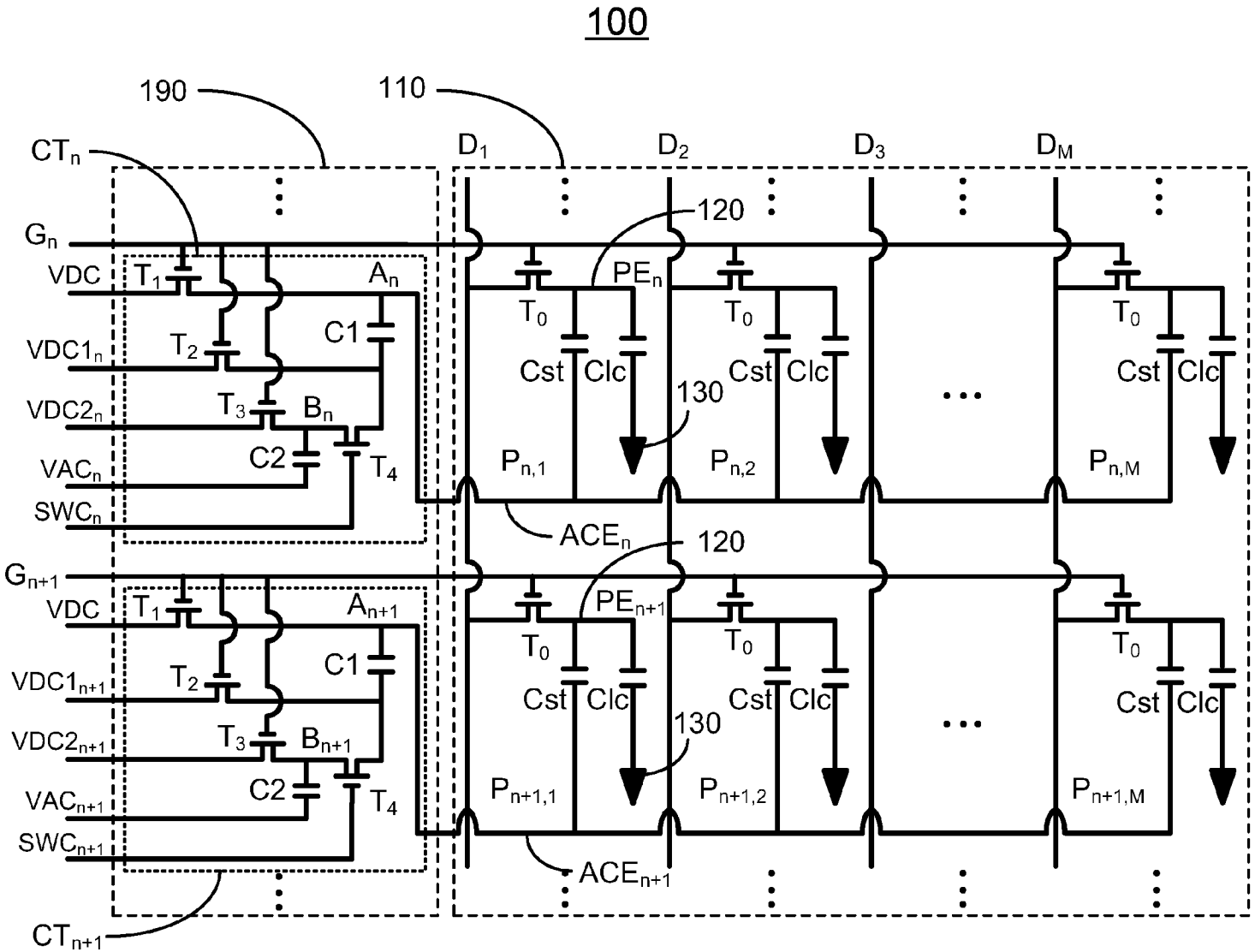
FIG. 1 shows schematically a partially circuit diagram of an LCD according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-5. In accordance with the purposes of this invention, as embodied and broadly described herein, this invention, in one aspect, relates to an LCD that utilizes a two-level lift-up coupling voltage driving scheme to achieve the row inversion and a method of driving same. The use of the two-level lift-up coupling voltage mechanism is able to reduce the swing frequency of the common voltage driver, and avoid larger voltage outputs from the source driver, thereby, reducing the power consumption of the common voltage and source drivers.

Referring to FIG. 1, an LCD panel 100 according to one embodiment of the present invention is partially and schematically shown. The LCD panel 100 includes a common electrode 130, a plurality of scanning lines, $G_1, G_2, \ldots, G_n, G_{n+1}, \ldots, G_n$, that are spatially arranged along a row (scanning) direction, and a plurality of data lines, $D_1, D_2, \ldots, D_m, D_{m+1}, \ldots, D_M$, that are spatially arranged crossing the plurality of scanning lines $G_1, G_2, \ldots, G_n, G_{n+1}, \ldots, G_N$ along a column direction that is perpendicular to the row direction 130. N and M are integers greater than one. The LCD panel 100 further has a plurality of pixels, $\{P_{n,m}\}$, that is spatially arranged in the form of a matrix. Each pixel row is defined between two neighboring scanning lines $G_n$ and $G_{n+1}$ and has an auxiliary common electrode $ACE_n$. Each pixel $P_{n,m}$ is defined between two neighboring scanning lines $G_n$ and $G_{n+1}$ and two neighboring data lines $D_m$ and $D_{m+1}$. For the purpose of illustration of embodiments of the present invention, FIG. 1 schematically shows only two scanning lines $G_n$, $G_{n+1}$, four data lines $D_1$, $D_2$, $D_3$ and $D_M$, and six corresponding pixels, $P_{n,1}$, $P_{n,2}$, $P_{n,M}$, $P_{n+1,1}$, $P_{n+1,2}$, and $P_{n+1,M}$, of the LCD panel 100.

Each pixel $P_{n,m}$ has a pixel electrode 120, a transistor, T0, having a gate, a source and a drain electrically coupled to the scanning line $G_n$, the data line $D_m$ and the pixel electrode 120, respectively, a liquid crystal capacitor, Clc, electrically coupled between the pixel electrode 120 and the common electrode 130, and a charge storage capacitor, Cst, electrically coupled between the pixel electrode 120 and the auxiliary common electrode $ACE_n$. In one embodiment, the auxiliary common electrode $ACE_n$ may be formed individually for each pixel, and the individually formed auxiliary common electrodes in such a pixel row are electrically connected to one another.

The LCD 100 further includes a gate driver and a data driver (not shown). The gate driver is adapted for generating a plurality of scanning signals, $\{g_n\}$, respectively applied to the plurality of scanning lines $\{G_n\}$. The plurality of scanning signals $\{g_n\}$ is configured to turn on the transistors connected to the plurality of scanning lines $\{G_n\}$ in a predefined sequence. The data driver is adapted for generating a plurality of data signals, $\{d_n\}$, respectively applied to the plurality of data lines $\{D_m\}$.

In one embodiment, each of the plurality of scanning signals $\{g_n\}$ is configured to have a waveform having a first voltage potential, $V_{GH}$, and a second voltage potential, $V_{GL}$, where $V_{GH}>V_{GL}$. The waveform of each scanning signal $g_n$, is sequentially shifted from one another.

The LCD 100 also includes a plurality of common voltage driving circuits $\{CT_n\}$ Each common voltage driving circuit $CT_n$ is electrically coupled between the scanning line $G_n$ and the corresponding auxiliary common electrode $ACE_n$ and includes a first transistor, T1, a second transistor, T2, a third transistor, T3, a fourth transistor, T4, a first capacitor, C1, and a second capacitor, C2.

The first transistor T1 has a gate electrically coupled to the scanning line $G_n$, a source configured to receive a first voltage, VDC, and a drain electrically coupled to the auxiliary common electrode $ACE_n$. The second transistor T2 has a gate electrically coupled to the scanning line $G_n$, a source configured to receive a second voltage, $VDC1_n$, and a drain. The third transistor T3 has a gate electrically coupled to the scanning line $G_n$, a source configured to receive a third voltage, $VDC2_n$, and a drain. The fourth transistor T4 has a gate configured to receive a fourth voltage, $SWC_n$, a source electrically coupled to the drain of the third transistor T3, and a drain electrically coupled to the drain of the second transistor T2. The first capacitor C1 has a first terminal electrically coupled to the drain of the first transistor T1 and a second terminal electrically coupled to the drain of the second transistor T2. The second capacitor C2 has a first terminal electrically coupled to the drain of the third transistor T3 and a second terminal configured to receive a fifth voltage, $VAC_n$.

Each of the first voltage VDC, the second voltage $VDC1_n$ and the third voltage $VDC2_n$ is a DC voltage. In one embodiment, $VDC1_n=VDC2_{n+1}$, and $VDC2_n=VDC1_{n+1}$.

Additionally, each of the fourth voltage $SWC_n$ and the fifth voltage $VAC_n$ is an AC voltage and characterized with a waveform having a high voltage potential and a low voltage potential. For example, the waveform of the fourth voltage $SWC_n$ has a high voltage potential, $V_{GH}$, and a low voltage potential, $V_{GL}$. The waveform of each fourth voltage $SWC_n$ is sequentially shifted from one another. In one embodiment, the waveform of the fourth voltage $SWC_n$ is configured to be complimentary to the waveform of a corresponding scanning signal $g_n$, i.e., when the fourth voltage $SWC_n$ is in its voltage potential, $V_{GH}$, the corresponding scanning signal $g_n$ is in the low potential $V_{GL}$, and vice versus. Further, the waveform of the fifth voltage $VAC_n$ has a high voltage potential, VcomH, and a low voltage potential, VcomL. The waveform of each fifth voltage $VAC_n$ is also sequentially shifted from one another. The time charts of the fourth voltage $SWC_n$ and the fifth voltage $VAC_n$ are shown in FIGS. 2 and 3.

For such an arrangement, in operation, the DC voltage signals of the first voltage VDC, the second voltage $VDC1_n$, and the third voltage $VDC2_n$ are coupled to the AC voltage signal of the fourth voltage $VAC_n$, which is charged to the charge storage capacitors Cst of the corresponding pixel row, thereby reducing driving voltages, i.e., the data signals $\{d_m\}$, applied to the data lines $\{D_m\}$.

According to the present invention, the plurality of pixels, $\{P_{n,m}\}$ is formed in an active area 110 of a panel of the LCD, which is an area for display of images, and the plurality of common voltage driving circuits $\{CT_n\}$ is formed in a non-active area 190 of the panel. The non-active area 190 is adjacent to the active area 110. The panel usually formed to have a multilayer structure, which is known to people skilled in the art.

Figure 2:
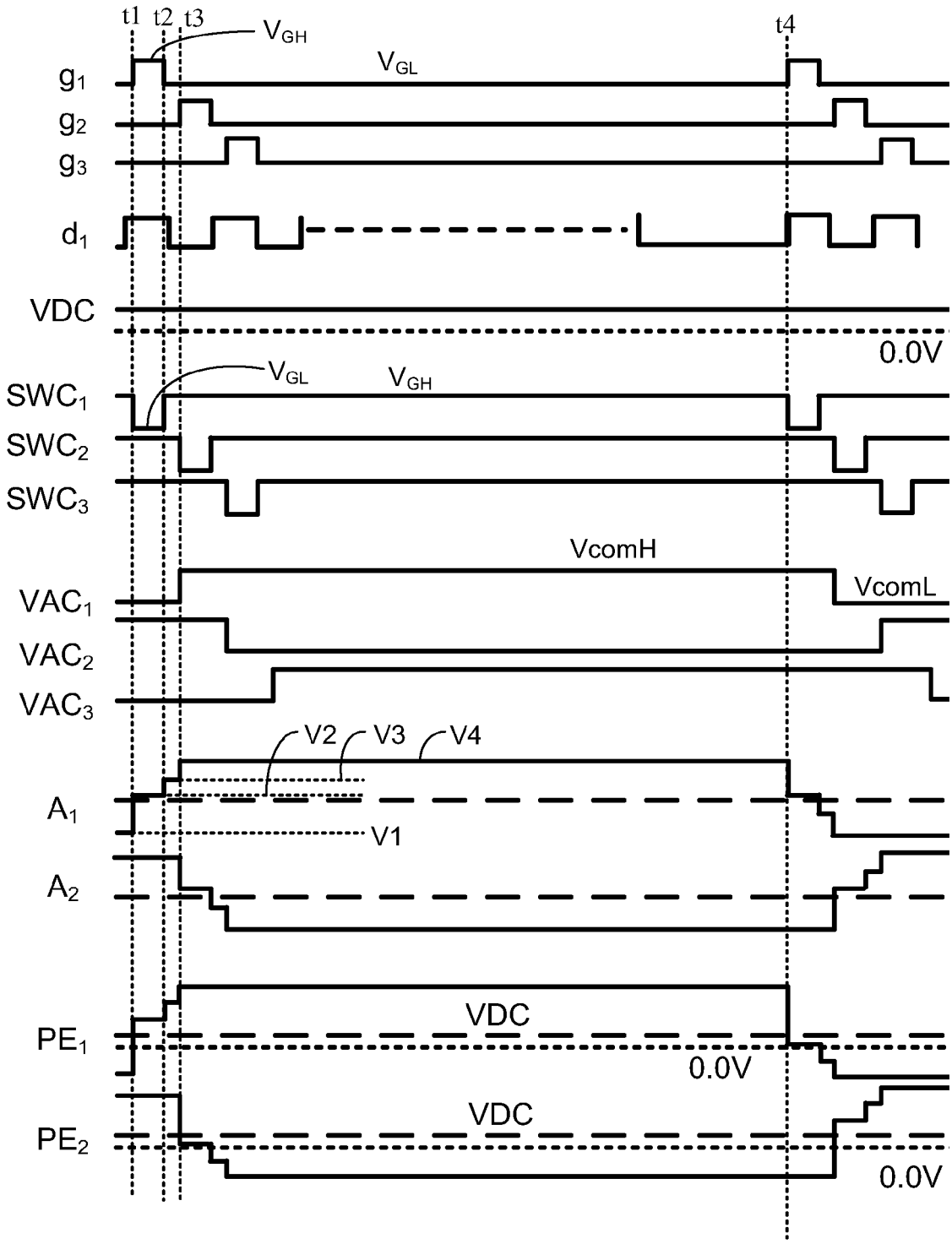
FIG. 2 shows time charts of driving signals applied to the LCD and corresponding pixel voltage potentials in the LCD according to one embodiment of the present invention.
Figure 3:
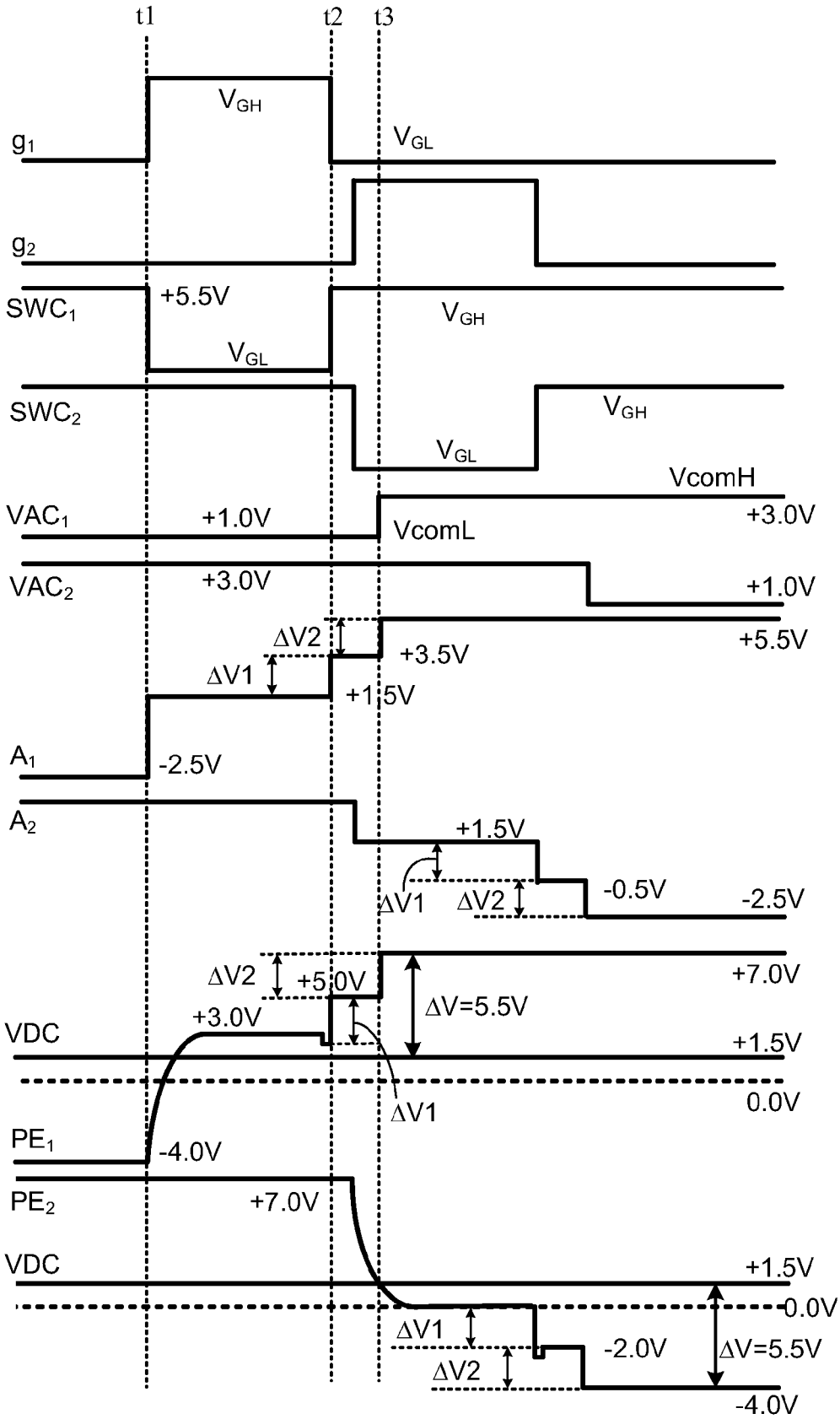
FIG. 3 shows time charts of driving signals applied to the LCD and corresponding pixel voltage potentials in the LCD according to another embodiment of the present invention.

FIG. 2 shows exemplary time charts of driving signals applied to the LCD and corresponding pixel voltage potentials in the LCD according to one embodiment of the present invention. In the charts, $g_1$, $g_2$ and $g_3$ are the scanning signals applied to the scanning lines (gates) $G_1$, $G_2$ and $G_3$, respectively. Each of the scanning signals $g_1$, $g_2$ and $g_3$ is characterized with a waveform having a high voltage potential $V_{GH}$ for a duration of T and a low voltage potential $V_{GL}$ for other duration in one frame. In the embodiment, T=(t2−t1), the frame is t4−t1. The waveforms of the scanning signals $g_1$, $g_2$ and $g_3$ are sequentially shifted for one frame. $d_1$ is the data signal applied to the data line $D_1$.

VDC is the first voltage signal applied to the source of the first transistor T1 of each common voltage driving circuit. $SWC_1$, $SWC_2$ and $SWC_3$ are the fourth voltage signals applied to the gate of the fourth transistor T4 of the first common voltage driving circuit $CT_1$, the second common voltage driving circuit $CT_2$ and the third common voltage driving circuit $CT_3$, respectively. Each of the fourth voltage signals $SWC_1$, $SWC_2$ and $SWC_3$ is characterized with a waveform having a high voltage potential $V_{GH}$ and a low voltage potential $V_{GL}$ for a duration of T, which is complimentary to the waveform of the corresponding scanning signals $g_1$, $g_2$ or $g_3$. $VAC_1$, $VAC_2$ and $VAC_3$ are the fifth voltage signals applied to the second terminal of the second capacitor C2 of the first common voltage driving circuit $CT_1$, the second common voltage driving circuit $CT_2$ and the third common voltage driving circuit $CT_3$, respectively. Each of the fifth voltage signals $VAC_1$, $VAC_2$ and $VAC_3$ is characterized with a waveform having a high voltage potential VcomH and a low voltage potential VcomL. The waveforms of the fifth voltage signals $VAC_1$, $VAC_2$ and $VAC_3$ are sequentially shifted in one frame.

$A_1$ and $A_2$ are the coupling voltage potentials generated by the first common voltage driving circuit $CT_1$ and the second common voltage driving circuit $CT_2$ in response to the first set of the first, second, third, fourth and fifth voltage signals VDC, $VDC1_1$, $VDC2_1$, $VAC_1$ and $SWC_1$, and the second set of the first, second, third, fourth and fifth voltage signals and VDC, $VDC1_2$, $VDC2_2$, $VAC_2$ and $SWC_2$, respectively. The coupling voltage potentials $A_1$ and $A_2$ are applied to the auxiliary common electrodes $ACE_1$ and $ACE_2$, thereby charging the storage capacitors Cst of each pixel of the first and second pixel rows, respectively. $PE_1$ and $PE_2$ are the corresponding voltage potentials generated at each pixel electrode of the first and second pixel rows, respectively. $PE_1$ and $PE_2$ are proportional to $A_1$ and $A_2$, respectively. As an example, $A_1$ is described in details as follows.

As shown in FIG. 2, at time t1, the first gate signal $g_1$ experiences a change from the low voltage potential $V_{GL}$ to the high voltage potential $V_{GH}$, while the fourth voltage signals $SWC_n$ experiences a reversed change, i.e., from the high voltage potential $V_{GH}$ to the low voltage potential $V_{GL}$.

In the duration from time t1 to t2, the first, second and third transistors T1, T2 and T3 are turned on and the fourth transistor T4 is turned off. Accordingly, the DC voltage potentials of the first and second voltage signals VDC and $VDC1_1$ are applied to charge the first capacitor C1, and the DC voltage potential of the third voltage signals $VDC2_1$ and the AC voltage potential of the fifth voltage signal $VAC_1$ are applied to charge the second capacitor C2. Thus, V2 is associated with only the DC voltage potentials of the first and second voltage signals VDC and $VDC1_1$.

At time t2, the first gate signal $g_1$ experiences a change from the high voltage potential $V_{GH}$ to the low voltage potential $V_{GL}$, while the fourth voltage signals $SWC_1$ experiences a reversed change, i.e., from the low voltage potential $V_{GL}$ to the high voltage potential $V_{GH}$.

In the duration from time t2 to t3, the first, second and third transistors T1, T2 and T3 are turned off and the fourth transistor T4 is turned on. $A_1$ does not change and equals to V3.

From time t1 to t3, the fifth voltage signal $VAC_1$ is in its low voltage potential VcomL. However, at time t3, the AC voltage potential of the fifth voltage signal $VAC_1$ experiences a change the low voltage potential VcomL to the high voltage potential VcomH. Still, the first, second and third transistors T1, T2 and T3 are turned off and the fourth transistor T4 is turned on. Accordingly, $A_1$ experiences a voltage potential increase from V3 to V4. The voltage potential change, $\Delta V2=(V4-V3)$, at this time (t3), is considered as a second level lift-up of the coupling voltage potential $A_1$.

From time t3 to t4, the fifth voltage signal $VAC_1$ is in its high voltage potential VcomH, and the first, second and third transistors T1, T2 and T3 are turned off and the fourth transistor T4 is turned on. As a result, $A_1$ remains unchanged, which is equal to V4.

It is clear that due to the two-level lift-ups, the coupling voltage potential A1 is substantially increased or decreased. When applied to the storage capacitor Cst of each pixel of the first pixel row, it results a substantial increase or decrease of the voltage potential $PE_1$ at the pixel electrode of each pixel of the first pixel row, without increasing or decreasing the voltage potentials of the source data signal $\{d_m\}$, thereby, reducing the power consumption of the data driver.

Similarly, the above discussion is also applicable to the coupling voltage potentials generated by other common voltage driving circuits.

Furthermore, according to the invention, as shown in FIG. 2, $PE_1$ and $PE_2$ are inverted to each other. As a result, the row inversion is achieved.

FIG. 3 shows time charts of driving signals applied to the LCD and corresponding pixel voltage potentials in the LCD according to another embodiment of the present invention. In this exemplary embodiment, VDC=1.5V, $VDC1_1$=3.0V, $VDC2_1$=1.0V, $VDC1_2$=1.0V, $VDC2_2$=3.0V, VcomL=1.0V, VcomH=3.0V. At t1, $g_1$ is changed to its high level, $V_{GH}$, and SWC1 is changed to its low level, $V_{GL}$, the first, second and third transistors T1, T2 and T3 are turned on and the fourth transistor T4 is turned off, A1 is changed from −2.5V to 1.5V. Then, in the duration of t2−t1, $g_1$ is hold in $V_{GH}$, and SWC1 is hold in $V_{GL}$, A1 is hold in 1.5V. At t2, g1 is changed to low level, $V_{GL}$, and SWC1 is changed to its high level, $V_{GH}$, the first, second and third transistors T1, T2 and T3 are turned off and the fourth transistor T4 is turned on, A1 is lifted-up to 3.5V because there are 2V between the two terminals of the capacitor C2 when the third transistor T3 is turned on ($\Delta V1$=3.5V−1V). In the duration of t3−t2, $g_1$ is hold in $V_{GL}$, and $SWC_1$ is hold in $V_{GH}$, A1 is hold in 3.5V. At t3, $g_1$ is hold in $V_{GL}$, $SWC_1$ is hold in $V_{GH}$, and VAC1 is changed from VcomL to VcomH, the first, second and third transistors T1, T2 and T3 is turned off and the fourth transistor T4 is turned on, and A1 is lifted-up to 5.5V ($\Delta V2$=3V−1V) because of the variation of VAC1. Accordingly, the first lift-up voltage is about 2V and the second lift-up voltage is about 2V, i.e., the total two level lift up of the coupling voltage potential is about ($\Delta V1+\Delta V2$)=4.0V.

Figure 4:
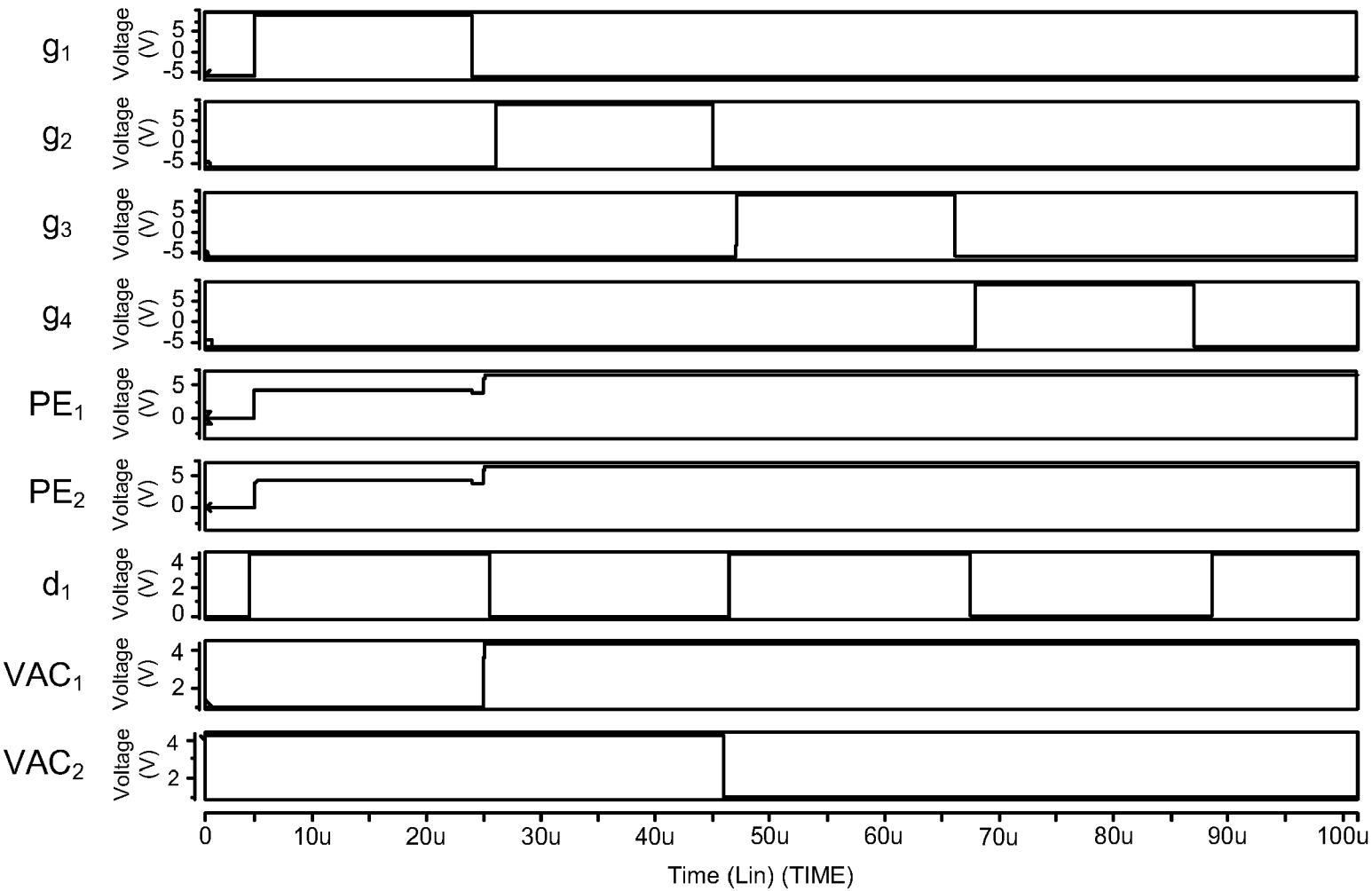
FIG. 4 shows an HSpice simulation for a TMD Vcom row inversion on a 6×8 pixel matrix of an LCD.

FIG. 4 shows an HSpice simulation for a TMD DCcom row inversion on a matrix of 6×8 pixels, with voltage settings: for the gate signals: $V_{GH}$=9.0V, $V_{GL}$=−6.0V, for the source signals: $V_{SH}$=4.3V, $V_{SL}$=0.0V, for the fifth voltage signal $VAC_n$: VcomH=2.7V, VcomL=1.0V, the first voltage signal VDC=1.81V. The simulation result is LC difference voltage: 4.837V (white) and 0.476V (black), and RMS power: 4.975 μW (white, 2 frames).

As a comparison, an HSpice simulation for a traditional row inversion on a matrix of 6×8 pixels is also conducted, with voltage settings: for the gate signals: $V_{GH}$=9.0V, $V_{GL}$=−6.0V, for the source signals: $V_{SH}$=5.0V, $V_{SL}$=0.0V, for the fifth voltage signal $VAC_n$: VcomH=5.0V, VcomL=0.0V. The simulation result is LC difference voltage: 4.639V and RMS power: 21.78 μW. It is clear that the traditional row inversion LCD consumes more power than the TMD DCcom row inversion LCD does.

Figure 5:
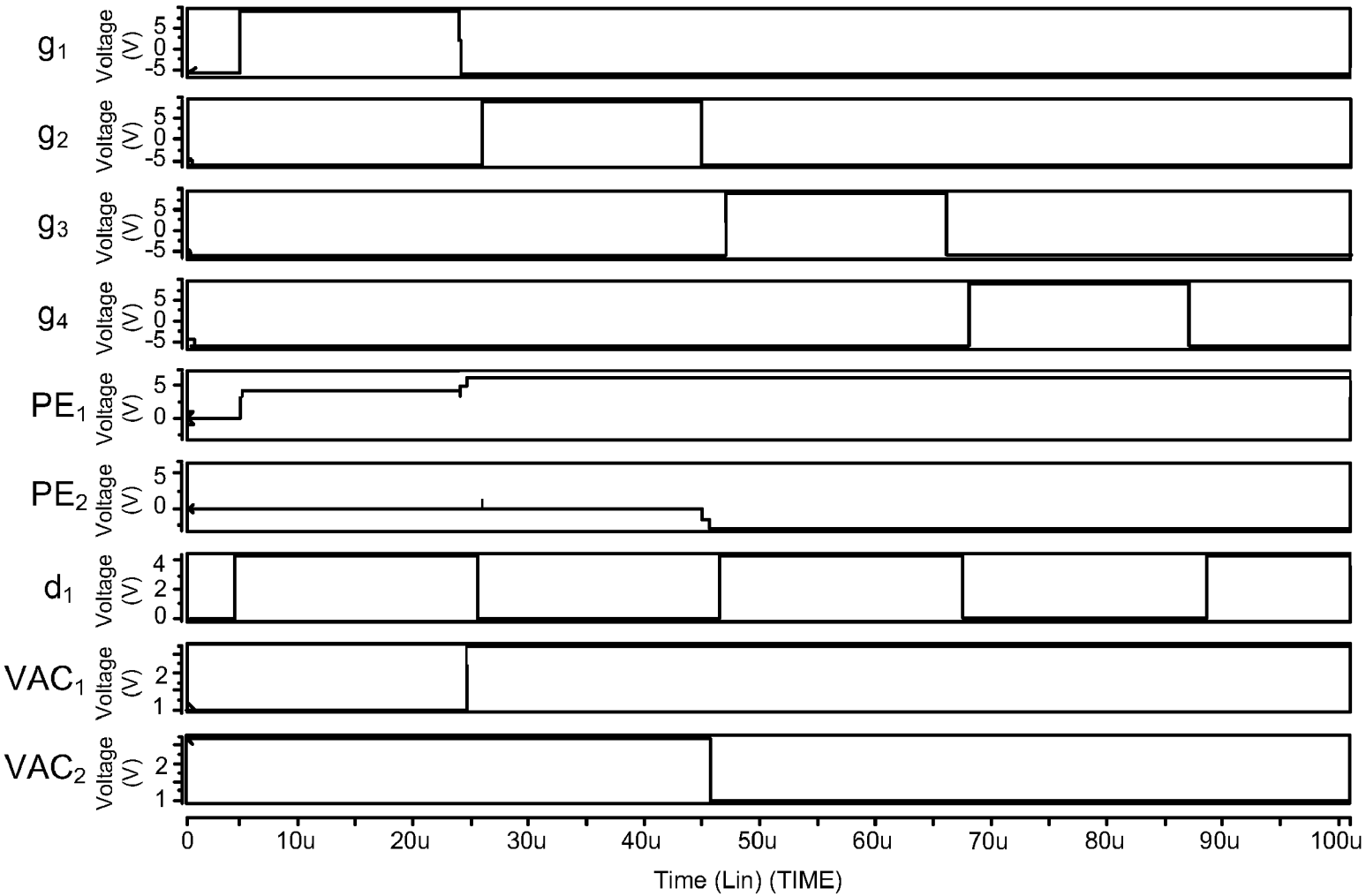
FIG. 5 shows an HSpice simulation for a two level lift-up row inversion on a 6×8 pixel matrix of an LCD according to one embodiment of the present invention.

FIG. 5 shows an HSpice simulation for a two-level lift-up row inversion on a matrix of 6×8 pixels, with voltage settings: for the gate signals: $V_{GH}$=9.0V, $V_{GL}$=−6.0V, for the source signals: $V_{SH}$=4.3V, $V_{SL}$=0.0V, for the fifth voltage signal $VAC_n$: VcomH=2.7V, VcomL=1.0V, the first voltage signal VDC=1.81V. The simulation result is LC difference voltage: 4.837V (white) and 0.517V (black), and RMS power: 3.748 μW (white, 2 frames). Comparing to the traditional row inversion LCD and the TMD DCcom row inversion LCD, the two-level lift-up row inversion LCD consumes much less power.

Another aspect of the present invention provides a method of driving the LCD disclosed in FIG. 1. In one embodiment, the method includes the following steps: at first, a plurality of common voltage driving circuits $\{CT_n\}$ is provided. Each common voltage driving circuit $CT_n$, electrically coupled between the scanning line $G_n$ and the corresponding auxiliary common electrode $ACE_n$. Then, a plurality of scanning signals $\{g_n\}$ and a plurality of data signals $\{d_m\}$ are respectively applied to the plurality of scanning lines $\{G_n\}$ and the plurality of data lines $\{D_m\}$. The plurality of scanning signals $\{g_n\}$ is configured to turn on the transistors T0 (switching element) connected to the plurality of scanning lines $\{G_n\}$ in a predefined sequence. Meanwhile, a plurality of common voltage driving signals is applied to the plurality of common voltage driving circuits $\{CT_n\}$ so as to responsively generate a plurality of two-level lift-up coupling voltages. Each two-level lift-up coupling voltage is applied to the auxiliary common electrode $ACE_n$ of a corresponding pixel row. Each common voltage driving signal includes a set of a first voltage VDC, a second voltage $VDC1_n$, a third voltage $VDC2_n$, a fourth voltage $SWC_n$, and a fifth voltage $VAC_n$.

Each of the first voltage VDC, the second voltage $VDC1_n$ and the third voltage $VDC2_n$ is a DC voltage, while ach of the fourth voltage $SWC_n$ and the fifth voltage $VAC_n$ is an AC voltage. In one embodiment, $VDC1_n=VDC2_{n+1}$, and $VDC2_n=VDC1_{n+1}$, and wherein the fourth voltage $SWC_n$ is characterized a waveform that is complimentary to the waveform of a corresponding gate signal $g_n$.

In sum, the present invention, among other things, recites an LCD that utilizes common voltage driving circuits to generate two level lift-up coupling voltages with each applied to the common electrode of the storage capacitor $C_{st}$ of each pixel of a corresponding pixel rows so as to achieve the row inversion and reduce power consumption of the data driver and methods of driving same.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A liquid crystal display (LCD), comprising:

(a) a common electrode;

(b) a plurality of scanning lines, $\{G_n\}$, n=1, 2, . . . , N, N being an integer greater than zero, spatially arranged along a row direction;

(c) a plurality of data lines, $\{D_m\}$, m=1, 2, . . . , M, M being an integer greater than zero, spatially arranged crossing the plurality of scanning lines $\{G_n\}$ along a column direction perpendicular to the row direction;

(d) a plurality of pixels, $\{P_{n,m}\}$, spatially arranged in the form of a matrix, each pixel row, defined between two neighboring scanning lines $G_n$ and $G_{n+1}$, having an auxiliary common electrode $ACE_n$, each pixel $P_{n,m}$, defined between two neighboring scanning lines $G_n$ and $G_{n+1}$ and two neighboring data lines $D_m$ and $D_{m+1}$, comprising:

(i) a pixel electrode;

(ii) a transistor, T0, having a gate, a source and a drain electrically coupled to the scanning line $G_n$, the data line $D_m$ and the pixel electrode, respectively;

(iii) a liquid crystal capacitor, Clc, electrically coupled between the pixel electrode and the common electrode; and (iv) a charge storage capacitor, Cst, electrically coupled between the pixel electrode and the auxiliary common electrode $ACE_n$, and (e) a plurality of common voltage driving circuits $\{CT_n\}$, each common voltage driving circuit $CT_n$, electrically coupled between the scanning line $G_n$ and the corresponding auxiliary common electrode $ACE_n$, comprising:

a first transistor, T1, a second transistor, T2, a third transistor, T3, and a fourth transistor, T4, each transistor having a gate, a source and a drain, wherein the gate of each of the first transistor T1, the second transistor T2 and the third transistor T3 is electrically coupled to the gate scanning line $G_n$, and the gate of the fourth transistor T4 is electrically coupled to a fourth voltage, $SWC_n$, that is inverse to a corresponding scanning signal, $g_n$ to be applied to the gate scanning line $G_n$.

2. The LCD of claim 1, wherein each common voltage driving circuit $CT_n$ further comprises a first capacitor, C1, having a first terminal electrically coupled to the drain of the first transistor T1 and a second terminal electrically coupled to the drain of the second transistor T2 and a second capacitor, C2, having a first terminal electrically coupled to the drain of the third transistor T3 and a second terminal configured to receive a fifth voltage, $VAC_n$, wherein (a) the source of the first transistor T1 is configured to receive a first voltage, VDC, and the drain of the first transistor T1 is electrically coupled to the auxiliary common electrode $ACE_n$;

(b) the source of the second transistor T2 is configured to receive a second voltage, $VDC1_n$;

(c) the source of the third transistor T3 is configured to receive a third voltage, $VDC2_n$; and (d) the source of the fourth transistor T4 is electrically coupled to the drain of the third transistor T3, and the drain of the fourth transistor T4 is electrically coupled to the drain of the second transistor T2.

3. The LCD of claim 1, further comprising:

(a) a gate driver for generating a plurality of scanning signals, $\{g_n\}$, respectively applied to the plurality of scanning lines $\{G_n\}$, wherein the plurality of scanning signals $\{g_n\}$ is configured to turn on the transistors T0 connected to the plurality of scanning lines $\{G_n\}$ in a predefined sequence; and (b) a data driver for generating a plurality of data signals, $\{d_m\}$, respectively applied to the plurality of data lines $\{D_m\}$.

4. The LCD of claim 3, wherein each of the plurality of scanning signals $\{g_n\}$ is configured to have a waveform having a first voltage potential, $V_{GH}$, and a second voltage potential, $V_{GL}$, wherein $V_{GH}>V_{GL}$, and wherein the waveform of each scanning signal $g_n$ is sequentially shifted from one another.

5. The LCD of claim 4, wherein each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

6. The LCD of claim 5, wherein $VDC1_n=VDC2_{n+1}$, and $VDC2_n=VDC1_{n+1}$, and wherein the fourth voltage $SWC_n$ is characterized with a waveform that is complimentary to the waveform of a corresponding gate signal $g_n$.

7. The LCD of claim 6, wherein, in operation, the plurality of pixels $\{P_{n,m}\}$ has a pixel polarity that is in the row inversion.

8. The LCD of claim 1, further comprising a panel having an active area for display and a non-active area adjacent to the active area, wherein the plurality of pixels, $\{P_{n,m}\}$ is formed in the active area of the panel, and wherein the plurality of common voltage driving circuits $\{CT_n\}$ is formed in the non-active area of the panel.

9. A liquid crystal display (LCD) having a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, comprising:

(a) a common electrode;

(b) a plurality of pixels, $\{P_{n,m}\}$, spatially arranged in the form of a matrix having N pixel rows and M pixel columns, each pixel row, defined between two neighboring scanning lines $G_n$ and $G_{n-1}$ having an auxiliary common electrode $ACE_n$, each pixel $P_{n,m}$, defined between two neighboring scanning lines $G_n$ and $G_{n+1}$ and two neighboring data lines $D_m$ and $D_{m+1}$, comprising:

(i) a pixel electrode;

(ii) a transistor, T0, having a gate, a source and a drain electrically coupled to the scanning line $G_n$, the data line $D_m$ and the pixel electrode, respectively;

(iii) a liquid crystal capacitor, Clc, electrically coupled between the pixel electrode and the common electrode 130; and (iv) a charge storage capacitor, Cst, electrically coupled between the pixel electrode and the auxiliary common electrode $ACE_n$; and (c) a plurality of common voltage driving circuits $\{CT_n\}$, each common voltage driving circuit $CT_n$, electrically coupled between the scanning line $G_n$ and the corresponding auxiliary common electrode $ACE_n$ for providing a two-level lift-up coupling voltage to the auxiliary common electrode $ACE_n$.

10. The LCD of claim 9, wherein each common voltage driving circuit $CT_n$ comprises:

(a) a first transistor, T1, having a gate electrically coupled to the scanning line $G_n$, a source configured to receive a first voltage, VDC, and a drain electrically coupled to the auxiliary common electrode $ACE_n$;

(b) a second transistor, T2, having a gate electrically coupled to the scanning line $G_n$, a source configured to receive a second voltage, $VDC1_n$, and a drain;

(c) a third transistor, T3, having a gate electrically coupled to the scanning line $G_n$, a source configured to receive a third voltage, $VDC2_n$, and a drain;

(d) a fourth transistor, T4, having a gate configured to receive a fourth voltage, $SWC_n$, a source electrically coupled to the drain of the third transistor T3, and a drain electrically coupled to the drain of the second transistor T2;

(e) a first capacitor, C1, having a first terminal electrically coupled to the drain of the first transistor T1 and a second terminal electrically coupled to the drain of the second transistor T2; and (f) a second capacitor, C2, having a first terminal electrically coupled to the drain of the third transistor T3 and a second terminal configured to receive a fifth voltage, $VAC_n$.

11. The LCD of claim 10, further comprising:

(a) a gate driver for generating a plurality of scanning signals, $\{g_n\}$, respectively applied to the plurality of scanning lines $\{G_n\}$, wherein the plurality of scanning signals $\{g_n\}$ is configured to turn on the transistors T0 connected to the plurality of scanning lines $\{G_n\}$ in a predefined sequence; and (b) a data driver for generating a plurality of data signals, $\{d_m\}$, respectively applied to the plurality of data lines $\{D_m\}$.

12. The LCD of claim 11, wherein each of the plurality of scanning signals $\{g_n\}$ is configured to have a waveform having a first voltage potential, $V_{GH}$, and a second voltage potential, $V_{GL}$, wherein $V_{GH}>V_{GL}$, and wherein the waveform of each scanning signal $g_n$ is sequentially shifted from one another.

13. The LCD of claim 12, wherein each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

14. The LCD of claim 13, wherein $VDC1_n=VDC2_{n+1}$, and $VDC2_n=VDC1_{n+1}$, and wherein the fourth voltage $SWC_n$ is characterized with a waveform that is complimentary to the waveform of a corresponding gate signal $g_n$.

15. The LCD of claim 9, further comprising a panel having an active area for display and a non-active area adjacent to the active area, wherein the plurality of pixels, $\{P_{n,m}\}$ is formed in the active area of the panel, and wherein the plurality of common voltage driving circuits $\{CT_n\}$ is formed in the non-active area of the panel.

16. A method of driving a liquid crystal display (LCD) having a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, and a plurality of pixels, $\{P_{n,m}\}$, spatially arranged in the form of a matrix having N pixel rows and M pixel columns, each pixel row, defined between two neighboring scanning lines $G_n$ and $G_{+1}$, having an auxiliary common electrode $ACE_n$, each pixel $P_{n,m}$, defined between two neighboring scanning lines $G_n$ and $G_{n+1}$ and two neighboring data lines $D_m$ and $D_{m+1}$, comprising a pixel electrode, a common electrode, a transistor, T0, having a gate, a source and a drain electrically coupled to the scanning line $G_n$, the data line $D_m$ and the pixel electrode, respectively, a liquid crystal capacitor, Clc, electrically coupled between the pixel electrode and the common electrode, and a charge storage capacitor, Cst, electrically coupled between the pixel electrode and the auxiliary common electrode $ACE_n$; comprising the steps of:

(a) providing a plurality of common voltage driving circuits $\{CT_n\}$, each common voltage driving circuit $CT_n$, electrically coupled between the scanning line $G_n$ and the corresponding auxiliary common electrode $ACE_n$;

(b) applying a plurality of scanning signals, $\{g_n\}$, to the plurality of scanning lines $\{G_n\}$ and a plurality of data signals, $\{d_m\}$, to the plurality of data lines $\{D_m\}$, respectively, the plurality of scanning signals $\{g_n\}$ configured to turn on the transistors T0 connected to the plurality of scanning lines $\{G_n\}$ in a predefined sequence; and (c) applying a plurality of common voltage driving signals to the plurality of common voltage driving circuits $\{CT_n\}$ so as to responsively generate a plurality of two-level lift-up coupling voltages, each two-level lift-up coupling voltage applied to the auxiliary common electrode $ACE_n$ of a corresponding pixel row.

17. The method of claim 16, wherein each common voltage driving signal comprises a set of a first voltage, VDC, a second voltage, $VDC1_n$, a third voltage, $VDC2_n$, a fourth voltage, $SWC_n$, and a fifth voltage, $VAC_n$.

18. The method of claim 17, wherein each common voltage driving circuit comprises:

(a) a first transistor, T1, having a gate electrically coupled to the scanning line $G_n$, a source configured to receive the first voltage VDC, and a drain electrically coupled to the auxiliary common electrode $ACE_n$;

(b) a second transistor, T2, having a gate electrically coupled to the scanning line $G_n$, a source configured to receive the second voltage $VDC1_n$, and a drain;

(c) a third transistor, T3, having a gate electrically coupled to the scanning line $G_n$, a source configured to receive the third voltage $VDC2_n$, and a drain;

(d) a fourth transistor, T4, having a gate configured to receive the fourth voltage, $SWC_n$, a source electrically coupled to the drain of the third transistor T3, and a drain electrically coupled to the drain of the second transistor T2;

(e) a first capacitor, C1, having a first terminal electrically coupled to the drain of the first transistor T1 and a second terminal electrically coupled to the drain of the second transistor T2; and (f) a second capacitor, C2, having a first terminal electrically coupled to the drain of the third transistor T3 and a second terminal configured to receive the fifth voltage, $VAC_n$.

19. The method of claim 18, wherein each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

20. The method of claim 19, wherein $VDC1_n=VDC2_{n+1}$, and $VDC2_n=VDC1_{n+1}$, and wherein the fourth voltage $SWC_n$ is configured to have a waveform that is complimentary to a waveform of a corresponding gate signal $g_n$.

21. The method of claim 20, wherein, in operation, the plurality of pixels $\{P_{n,m}\}$ has a pixel polarity that is in the row inversion.

22. A common voltage driving circuit for a liquid crystal display (LCD) having a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction, n=1, 2, . . . , N, m=1, 2, . . . , M, and N, M being an integer greater than zero, and a plurality of pixels, $\{P_{n,m}\}$, spatially arranged in the form of a matrix having N pixel rows and M pixel columns, each pixel row, defined between two neighboring scanning lines $G_n$ and $G_{n+1}$, having an auxiliary common electrode $ACE_n$, comprising:

(a) a first transistor, T1, having a gate electrically coupled to the scanning line $G_n$, a source configured to receive a first voltage, VDC, and a drain electrically coupled to the auxiliary common electrode $ACE_n$;

(b) a second transistor, T2, having a gate electrically coupled to the scanning line $G_n$, a source configured to receive a second voltage, $VDC1_n$, and a drain;

(c) a third transistor, T3, having a gate electrically coupled to the scanning line $G_n$, a source configured to receive a third voltage, $VDC2_n$, and a drain;

(d) a fourth transistor, T4, having a gate configured to receive a fourth voltage, $SWC_n$, a source electrically coupled to the drain of the third transistor T3, and a drain electrically coupled to the drain of the second transistor T2;

(e) a first capacitor, C1, having a first terminal electrically coupled to the drain of the first transistor T1 and a second terminal electrically coupled to the drain of the second transistor T2; and (f) a second capacitor, C2, having a first terminal electrically coupled to the drain of the third transistor T3 and a second terminal configured to receive a fifth voltage, $VAC_n$.

23. The common voltage driving circuit of claim 22, wherein each of the first voltage VDC, the second voltage $VDC1_n$ and the third voltage $VDC2_n$ is a DC voltage, and wherein each of the fourth voltage $SWC_n$ and the fifth voltage $VAC_n$ is an AC voltage.

* * * * *